US005815582A

United States Patent [19]

Claybaugh et al.

[11] Patent Number: 5,815,582

[45] Date of Patent: Sep. 29, 1998

[54] ACTIVE PLUS SELECTIVE HEADSET

[75] Inventors: David Claybaugh, Germantown; Jeffrey N. Denenberg, Trumbull; Ralph Busch, Takoma Park; John Hohman, Towson, all of Md.

[73] Assignee: Noise Cancellation Technologies, Inc., Linthicum, Md.

[21] Appl. No.: 899,090

[22] Filed: Jul. 23, 1997

Related U.S. Application Data

[63] Continuation of Ser. No. 347,417, Dec. 2, 1994.

[51] Int. Cl.[6] ..... A61F 11/06; H03B 29/00

[52] U.S. Cl. ..... 381/71.6; 381/72

[58] Field of Search ..... 381/72, 74, 103, 381/94.9, 155, 71.1, 71.6, 71.11, 71.12; 181/206; 379/406, 407, 410, 412, 387, 388, 390, 395

[56] References Cited

U.S. PATENT DOCUMENTS

| | | | |
|---|---|---|---|
| 3,952,158 | 4/1976 | Kyle et al. . | |
| 4,061,875 | 12/1977 | Freifield et al. . | |
| 4,064,362 | 12/1977 | Williams . | |
| 4,654,871 | 3/1987 | Chaplin | 381/72 |
| 4,677,678 | 6/1987 | McCutchen . | |
| 4,953,217 | 8/1990 | Twiney et al. . | |
| 5,046,103 | 9/1991 | Warnaka et al. . | |
| 5,091,953 | 2/1992 | Tretter . | |
| 5,105,377 | 4/1992 | Ziegler, Jr. . | |
| 5,182,774 | 1/1993 | Bourk | 381/74 |

*Primary Examiner*—Minsun Oh Harvey

[57] ABSTRACT

An active plus selective headset system for provision of active attenuation of broadband noise as well as speech filtering comprising a headset with reference microphones, residual microphones and speakers on each of a pair of open backed muffs and a controller means.

20 Claims, 4 Drawing Sheets

ACTIVE PLUS SELECTIVE HEADSET

This application is a continuation, of application Ser. No. 08/347,417, filed Dec. 2, 1994, now abandoned.

BACKGROUND OF THE INVENTION

This invention relates to a headset for actively canceling unwanted noise while selectively allowing necessary speech to reach the user's ear.

In the past, attempts to combine the two protections, i.e., high and low frequency attenuation, has resulted in not only the noise being attenuated, but also the speech that the wearer needs to hear. Some systems met only limited success with fixed or "near-stationary" noise but not with the other noise of either (a) varying spectral characteristics or (b) brief duration noises with "spikes". Examples of such a system is found in U.S. Pat. No. 4,025,721, to Graupe et al and U.S. Pat. No. 4,185,168 to Graupe et al. Other systems like that found in U.S. Pat. No. 4,455,675 to Bose actively attenuate all sounds at low frequencies and passively attenuate all high frequency sounds. These sounds include speech and warning signals that want to be heard by the person wearing the headset.

SUMMARY OF THE INVENTION

The instant invention solves of total attenuation of the noise and speech, by providing a solution of an active headset that can employ any of several selective algorithms such as those disclosed in U.S. Pat. No. 4,654,871 to Chaplin, hereby incorporated by reference herein. Alternatively, this invention can employ the algorithm disclosed in U.S. Pat. No. 5,105,377 to Ziegler which is also incorporated herein by reference. In addition this invention can employ other algorithms such as that disclosed in the application of Ziegler in U.S. patent application Ser. No. 07/421 759; which is hereby incorporated by reference.

In applications for noise canceling headsets, particularly in industrial environments, attenuation of low frequency noise as well as noise that covers the speech band (300 to 3300 Hz) passive hearing protection works extremely well at higher frequencies (typically above 1000 Hz) whereas active noise cancellation has been shown to achieve similar levels of protection at lower frequencies (50 to 1000 Hz). Passive, however, also attenuates speech and warning signals and the protectors are uncomfortable to wear. This invention provides a solution that simultaneously provides the protection offered by a passive headset in a lightweight open back headset while using active adaptive feed forward control algorithms that attenuate all sounds in the 20 to 3300 Hz frequency band. Additionally, adaptive speech filtering or in-wire control technology separates speech from noise and passes the speech to the user.

Accordingly it is an object of this invention to provide an active noise canceling headset with selectivity.

Another object of this invention is the provision of an open back muff headset with selective filtering.

BRIEF DESCRIPTION OF THE DRAWINGS

These and other objects of this invention where reference is had to the accompanying drawings in which.

DETAILED DESCRIPTION OF THE INVENTION

Figure 1:
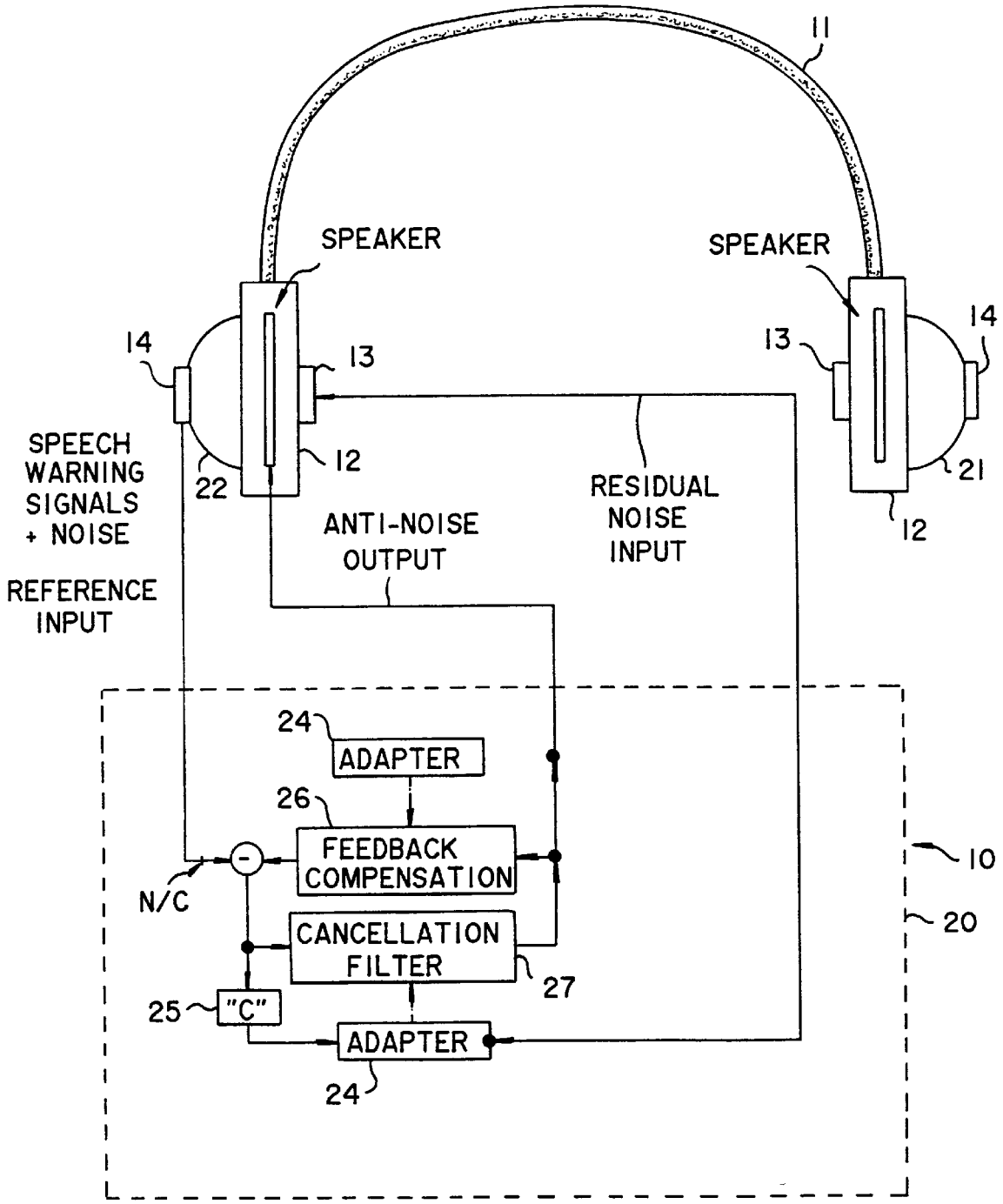
FIG. 1 shows a typical active/passive headset system incorporating the instant invention.

In FIG. 1 there is shown an active/passive closed back headset system 10. It consists of a typical passive headset 11, loudspeakers 12 that drive the anti-noise and residual microphones 13 to sense any remaining noise near the ear and reference microphones 14 to send advanced information for feed forward approaches and a system controller 20 which synthesizes the anti-noise signal.

The headset shown has closed backs 21, 22 for passive attenuation without the speakers, microphones and system controller, this headset would be a typical passive hearing protector.

The system is designed to use various algorithms such as that of Ziegler in U.S. Pat. No. 5,105,377 or an adaptive feed forward approach. Both these algorithms use a reference signal as inputs. The digital virtual earth (DVE) algorithm develops a reference signal by subtracting an equalized version of its own anti-noise signal from the residual signal. The adaptive feed forward uses the reference microphone as its input and is very effective on complicated noise environments that are broadband and random in character. The Least Means Square (LMS) adapter 24 shown in FIG. 1 are Filtered-X versions which have inherent compensation for the effects of the feedback delays around the loop. Box "C" at 25 is the impulse response of active cancellation system.

Feedback compensator 26 and cancellation filter 27 complete the component portions of the controller.

DVE is highly effective to use in simple noise environments having only a few harmonics even where the noise varies tremendously. It has also been demonstrated to be very effective doing broadband cancellation at low frequencies (50–700 Hz).

Speakers 12 of the headset are large enough to be capable of producing antinoise at the same level as the noise to be canceled. They have little or no distortion and have a minimum of input-to-output delay as any delay in the feedback loop slows down the system adaptation rate.

Residual microphones 13 are typically small electret microphones mounted on the speaker frame near the ear. They must faithfully reproduce the sound that remains at the ear after cancellation so that the controller can make further adjustments to the anti-noise signal.

Reference microphones 14 are small electret microphones attached to the outside of the headset at a distance from the ear canal. These referenced microphones are used to provide advanced information about the noise. The higher the frequency of the noise the more advanced information is needed to effectively cancel the noise.

Figure 2:
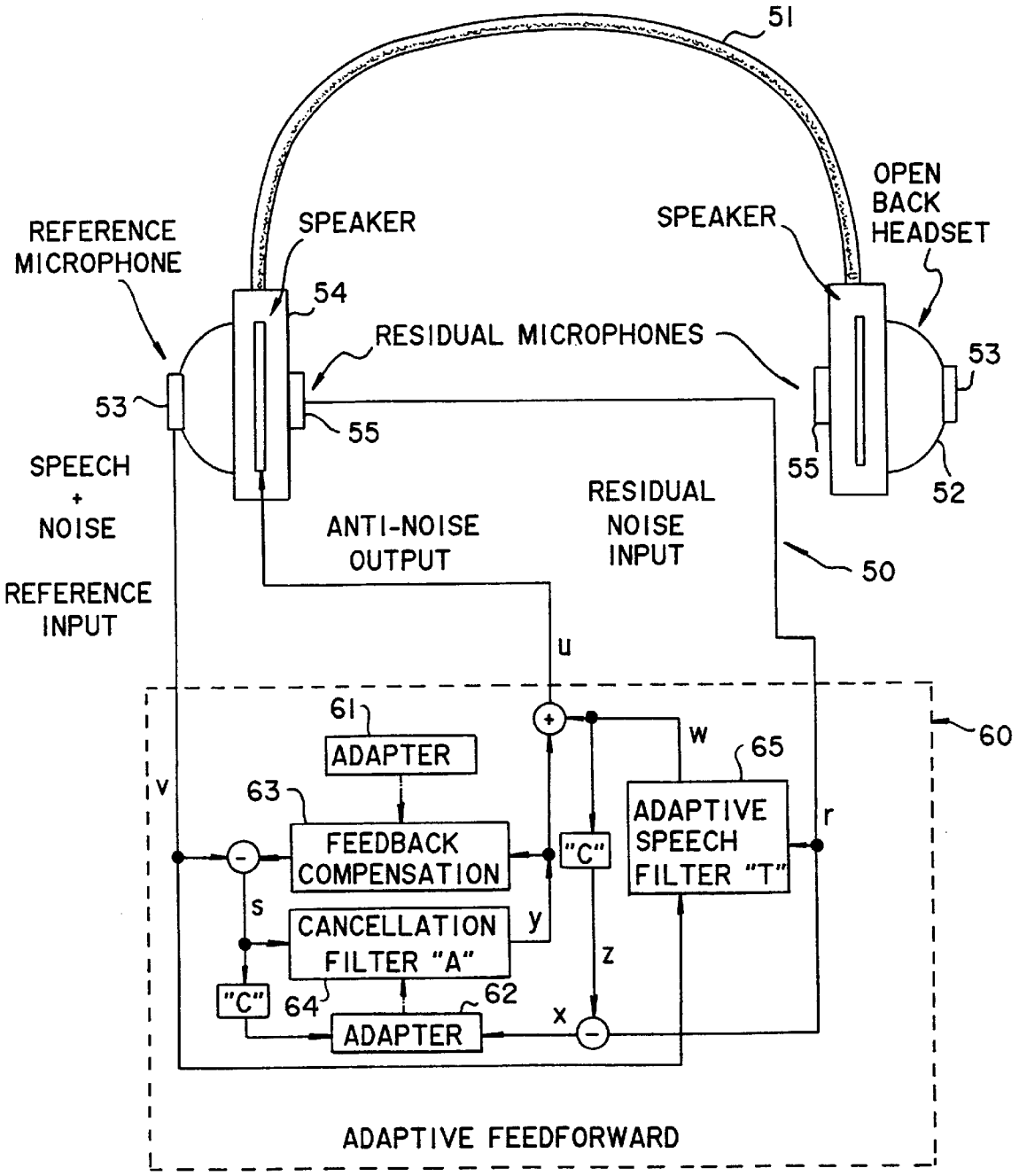
FIG. 2 shows an active plus selective headset system with an open back muff that incorporates active control and adaptive speech filtering to allow speech to pass with the "anti-noise" signal.

FIG. 2 shows an active plus selective headset system 50 with headset 51 having open backed muff positions 52, reference microphones 53, speakers 54 and residual microphones 55. An earplug (not shown) may be substituted for the open backed muff.

Figure 3:
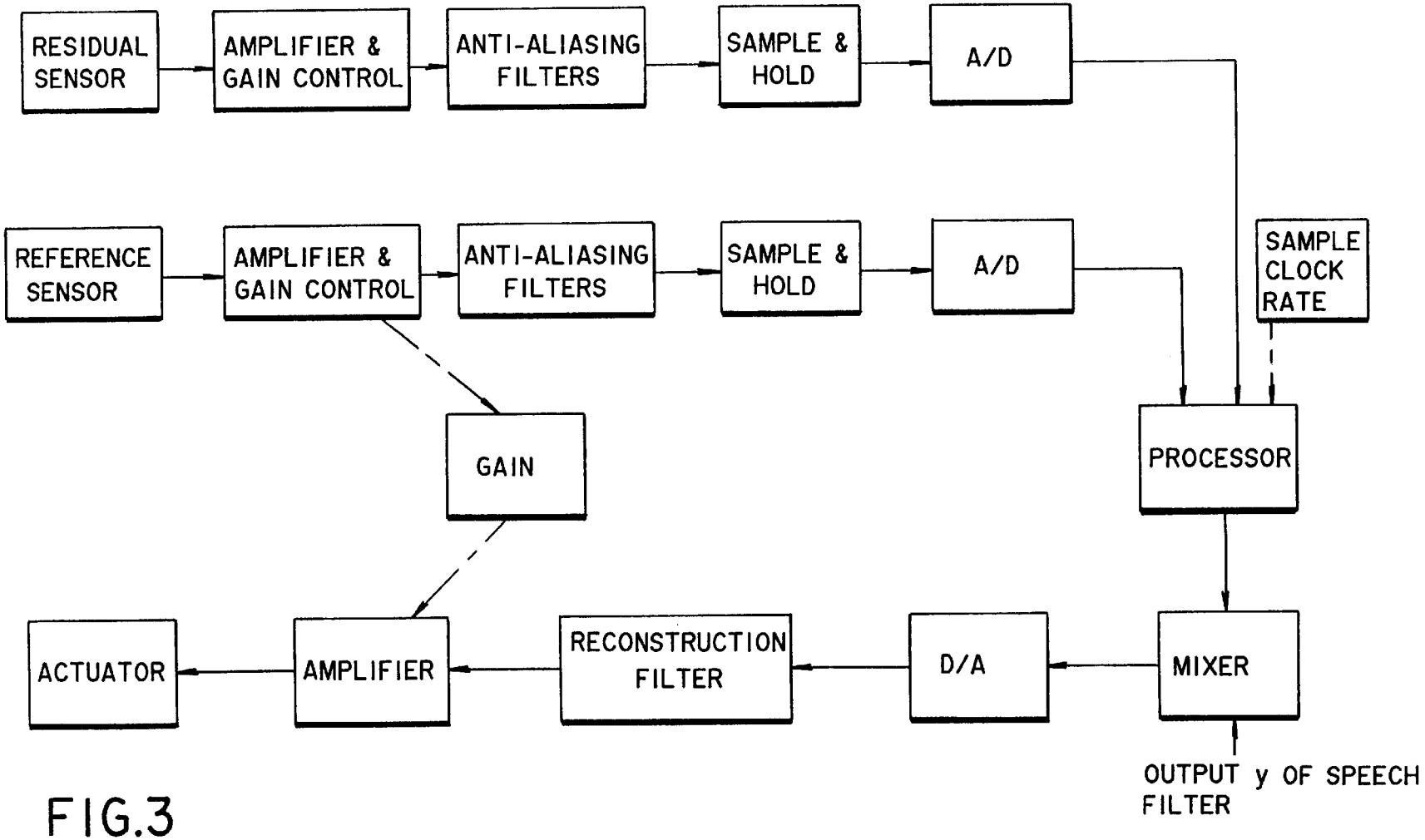
FIG. 3 shows a more detailed description of the active control system of FIG. 2.
Figure 4:
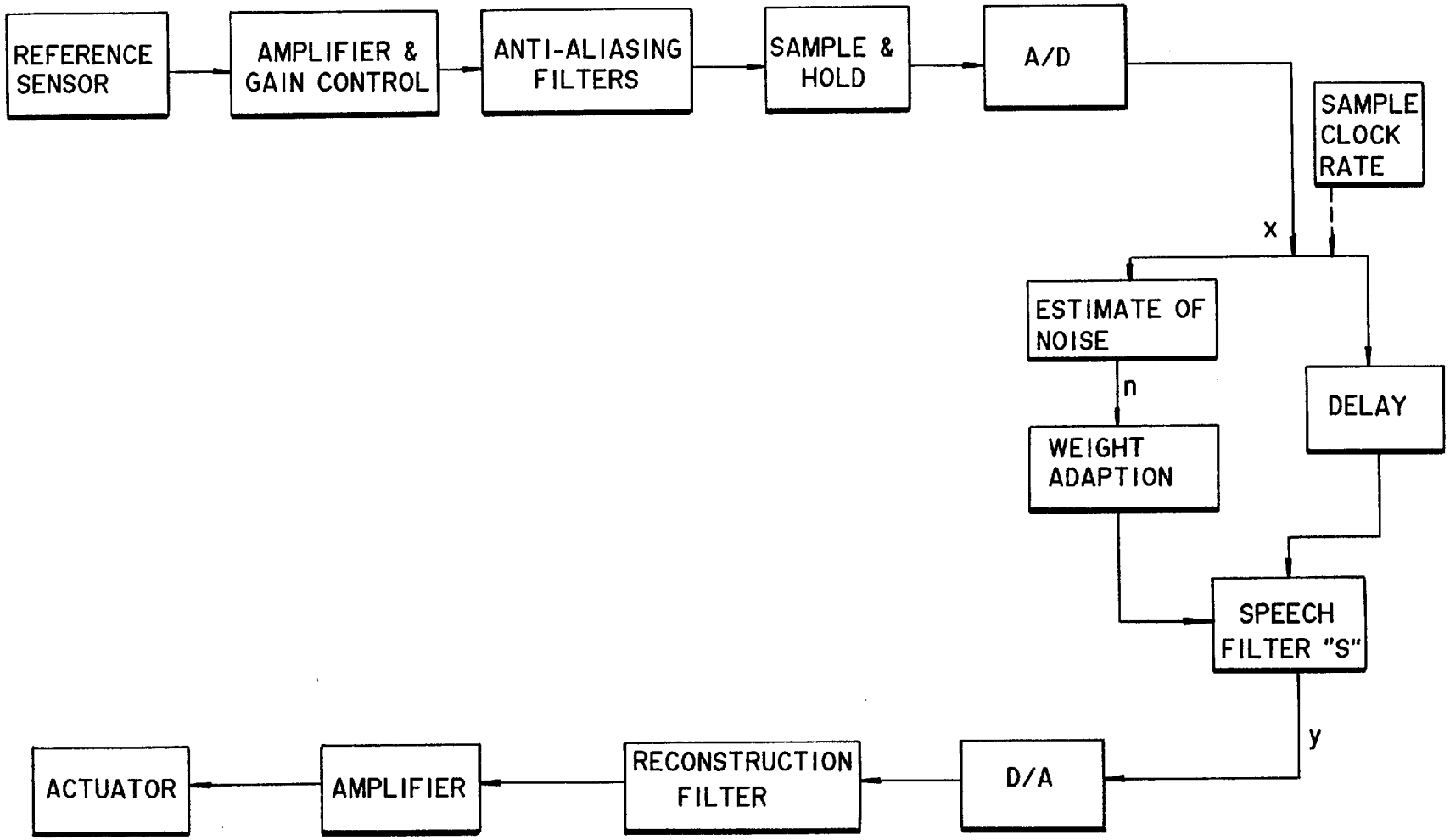
FIG. 4 shows a more detailed description of the adaptive speech filtering technique to be used in this headset design.

The active /passive system 10 previously described can be configured to actively attenuate all sounds in the frequency band from 20 to 3300 Hz without the need for a passive muff or earplug. The approach uses an adaptive feed forward control algorithm to actively attenuate the damaging noise in this band. In order to accomplish this it is necessary to minimize the delays of the digital signal processing system, which include delays introduced by the anti-aliasing and reconstruction filters shown in FIG. 3 and the acoustic delay of the speaker and residual microphone physical system, in order to effectively attenuate noise at the higher frequencies.

The controller 60 has adapters 61, 62, feedback compensation 63, cancellation filter 64 and adaptive speech filter 65. Controller 60 uses a parallel adaptive speech filtering technique to pass speech to the user. Adaptive speech filtering techniques can be employed to work with the particular noisy environment. The active controller attenuates noise in the band of interest and allows speech and warning signals to pass via the adaptive speech filtering path which incorporates a warning signal filter as shown in FIG. 2. It is similar to the active/passive system except for the open backed headset design and the addition of a parallel adaptive speech filtering path and warning signal filter path as integral parts of the controller. The input to the speech filter and controller are the upstream reference microphones 53.

This reference microphone contains noise and speech. The speech is filtered from the noise and passed with the "anti-noise" generated from the adaptive feed forward controller and sent to the headset loud speaker. Both speech and warning signals, which are typically above the speech band and of known frequencies, will be heard by the user of the lightweight and open back headset.

With reference to FIG. 2, the "anti-noise" and speech output signals are mixed and input to the speakers. This combined signal output sample, $u_k$, is given by $$x_k = r_k - z_k$$

$$y_k = A_k s_k$$

$$u_k = w_k + y_k$$

$u_k$ is the output speech and anti-noise value where $r_k$ is a vector of the most recent examples of the residual signal $z_k$ is a vector of the output of the speech filter after it passed through the impulse response $C_k$ $A_k$ is a vector of cancellation filter coefficients $y_k$ is the output anti-noise value $w_k$ is the output speech value.

$s_k$ is the vector of compensated inputs.

Inputs to the controller and speech filter are the reference signal, $v_k$, and residual signal $r_k$ that are picked up via the reference sensor and residual sensor respectively. The adaptive feedforward controller generates an "anti-noise", $y_k$, and the adaptive speech filter generates a clean speech signal, $w_k$, that are mixed to form the output signal $u_k$ which is sent to the speakers. Each ear piece operates independently with separate reference and residual sensors and actuator.

It is essential that the output of the speech filter, $w_k$, be filtered through the system in pulse response, $C_k$, and subtracted from the residual input, $r_k$, so as not to interfere with the operation of the adaptive feedforward controller. Otherwise, the controller will attempt to adapt to and cancel the speech signal that is output to the speaker.

Several techniques can be used to minimize the delays of the system. First, passive material can effectively act as a low pass filter for the input reference and residual sensors. This would eliminate the need for anti-aliasing filters and thus the delays introduced by these filters would be eliminated. This technique has been shown to be quite effective in the active control of noise in ducts using the adaptive feedforward controller.

Another technique removes neither the anti-aliasing filters nor the reconstruction filters but essentially by-passes the delays introduced by these filters by inserting an analog zero'th order tap. This is achieved by placing an amplifier between the output of the incoming gain control and the output of the reconstruction filters shown in FIG. 3.

A final technique, which will be even more effective as the speed of microprocessor technology increases, is to sample at a rate of 40 kHz or greater, this eliminates the need for anti-aliasing and reconstruction filters because the cut off frequency of 20 kHz is at the limit of the loudspeaker response.

We claim:

1. An active plus selective headset system which provides active broadband attenuation of noise as well as adaptive speech filtering, said system comprising:

a headset means adapted to be worn by a user;

reference sensing means on said headset means adapted to sense speech and noise signals;

speaker means on said headset means adapted to convey speech signals to a user's ear; and controller means adapted to control the speaker means based on input from the reference sensing means to provide active broadband attenuation of all random inband noise as well as adaptive speech filtering so that only the speech reaches the ear, wherein said active broadband attenuation is accomplished without synchronization pulses.

2. A system as in claim 1 wherein said headset means includes residual microphone means located on said headset means and including a feedback means connected to said speaker means.

3. A system as in claim 2 wherein said feedback means includes an adaptive speech filter means and a cancellation filter means.

4. A system as in claim 2 wherein said controller means is run by an adaptive feedforward algorithm.

5. A system as in claim 2 wherein said headset means includes an open backed muff.

6. A system as in claim 2 wherein said reference sensing means is an electret microphone.

7. A system as in claim 6 wherein said headset system comprises a pair of open backed muffs with the reference sensing means located on the outside of said muffs.

8. An active plus selective headset system which provides active broadband attenuation of noise as well as speech filtering, said system comprising:

a headset means adapted to be worn by a user, wherein said headset means includes residual microphone means located on said headset means and including a feedback means connected to said speaker means that includes an adaptive speech filter means adapted to filter speech from noise and a cancellation filter means;

reference sensing means on said headset means adapted to sense speech, noise and warning signals;

speaker means on said headset means adapted to convey speech and warning signals to a user's ear; and controller means adapted to control the speaker means based on input from the reference sensing means to provide active broadband attenuation of noise as well as speech filtering so that only the warning signals and speech reach the ear.

9. An active plus selective headset system which provides active broadband attenuation of noise as well as speech filtering, said system comprising:

a headset means adapted to be worn by a user, wherein said headset means includes residual microphone means located on said headset means and including a feedback means connected to said speaker means that includes an adaptive speech filter means and a cancellation filter means;

reference sensing means on said headset means adapted to sense speech, noise and warning signals:

speaker means on said headset means adapted to convey speech and warning signals to a user's ear; and controller means adapted to control the speaker means based on input from the reference sensing means to provide active broadband attenuation of noise as well as speech filtering so that only the warning signals and speech reach the ear;

wherein an output from said adaptive speech filtering means is mixed with an output from said controller means and a resulting signal passed to said speaker means.

10. An active plus selective headset system which provides active broadband attenuation of noise as well as speech filtering, said system comprising;

a headset means adapted to be worn by a user, wherein said headset means includes residual microphone means located on said headset means and including a feedback means connected to said speaker means that includes an adaptive speech filter means and a cancellation filter means;

reference sensing means on said headset means adapted to sense speech, noise and warning signals;

speaker means on said headset means adapted to convey speech and warning signals to a user's ear; and controller means adapted to control the speaker means based on input from the reference sensing means to provide active broadband attenuation of noise as well as speech filtering so that only the warning signals and speech reach the ear, wherein an output from said adaptive speech filtering means is filtered by an impulse response of the cancellation means and subtracted from a signal from the residual microphone so as not to interfere with operation of said controller means.

11. A system as in claim 1 wherein said reference sensing means is external of said speaker means on said headset means and said controller means is adapted to employ a feedforward method of noise cancellation.

12. A system as in claim 2 wherein said residual microphone means is internal of said speaker means on said headset means and said controller means is adapted to employ a feedback method of noise cancellation.

13. A headset system for providing active broadband attenuation of unwanted random inband noise, as well as adaptive speech filtering, comprising:

a pair of muffs, each of said muffs comprising:

a reference microphone attached to an outside portion of said muff for sensing speech signals and unwanted random inband noise signals;

a speaker located on an inside portion of said muff; and a controller attached to said reference microphone such that said signals sensed by said reference microphone act as an input to said controller; said controller producing an anti-noise output at said speaker to eliminate said unwanted random inband noise signals at a user's ear and removing noise from said speech signal by adaptive speech filtering so that the speech signals output to the user's ear is clearer, wherein said elimination of said unwanted random inband noise signals is accomplished without synchronization pulses.

14. A headset system as in claim 13, further comprising a residual microphone attached to said speaker for sensing any unwanted random inband noise near the user's ear and providing an output to said controller so that the anti-noise output can be adjusted to compensate for said unwanted random inband noise.

15. A headset system as in claim 13 wherein said controller includes a feedback compensator connected to said speaker.

16. A headset system for providing active broadband attenuation of unwanted noise, as well as speech filtering, comprising:

a pair of muffs, each of said muffs comprising:

a reference microphone attached to an outside portion of said muff for sensing speech signals, warning signals, and unwanted noise signals;

a speaker located on an inside portion of said muff; and a controller including a feedback compensator connected to said speaker and attached to said reference microphone such that said signals sensed by said reference microphone act as an input to said controller; said controller producing an anti-noise output at said speaker to eliminate said unwanted noise signal at a user's ear and removing noise from said speech signal so that the speech signals output to the user's ear is clearer.

wherein said feedback compensator includes an adaptive speech filter and a cancellation filter.

17. A headset system as in claim 13 wherein said controller is operated based on an adaptive feedforward algorithm.

18. A headset system as in claim 13 wherein said reference sensing microphone is an electret microphone.

19. A system as in claim 1 wherein the reference sensing means is adapted to additionally sense warning signals, the speaker means is adapted to convey speech and warning signals to the user, and the controller means is adapted to provide active broadband attenuation of noise as well as speech filtering so that only the warning signals and speech reach the ear.

20. A headset system as in claim 13, wherein the reference microphone additional senses warning signals.

* * * * *